US008047163B2

(12) United States Patent
Tian et al.

(10) Patent No.: US 8,047,163 B2
(45) Date of Patent: Nov. 1, 2011

(54) GAS WATER HEATER WITH HARMFUL GAS MONITORING AND WARNING FUNCTIONS AND THE METHOD OF MONITORING AND WARNING

(75) Inventors: Gang Tian, Nanjing (CN); Ju Ping, Nanjing (CN); Zhu Gaotao, Nanjing (CN); Bu Qiu, Nanjing (CN)

(73) Assignee: AOS Holding Company, Wilmington, DE (US)

( * ) Notice: Subject to any disclaimer, the term of this patent is extended or adjusted under 35 U.S.C. 154(b) by 690 days.

(21) Appl. No.: 11/957,849

(22) Filed: Dec. 17, 2007

(65) Prior Publication Data

US 2009/0151652 A1 Jun. 18, 2009

(51) Int. Cl.
*F24H 9/20* (2006.01)

(52) U.S. Cl. ..... 122/14.1; 122/504; 340/632

(58) Field of Classification Search ..... 122/14.1, 122/14.2, 14.21, 504; 340/632
See application file for complete search history.

(56) References Cited

U.S. PATENT DOCUMENTS 4,317,987 A * 3/1982 Fieldman ..... 219/506
4,568,821 A * 2/1986 Boe ..... 219/419
5,539,383 A * 7/1996 Chin ..... 340/604
5,630,408 A * 5/1997 Versluis ..... 122/14.21
5,844,492 A * 12/1998 Buffin, Sr. ..... 340/632
6,084,520 A * 7/2000 Salvucci ..... 340/605
RE37,745 E * 6/2002 Brandt et al. ..... 122/14.2
6,583,720 B1 * 6/2003 Quigley ..... 340/521
6,766,835 B1 * 7/2004 Fima ..... 141/95
6,816,069 B2 * 11/2004 Quigley ..... 340/521
7,167,813 B2 * 1/2007 Chian et al. ..... 702/183
7,242,310 B2 * 7/2007 Hotton et al. ..... 340/632
7,581,946 B2 * 9/2009 Donnelly et al. ..... 431/76
2002/0134322 A1 * 9/2002 Dolan ..... 122/504
2003/0128114 A1 * 7/2003 Quigley ..... 340/506
2003/0154932 A1 * 8/2003 Schell et al. ..... 122/504
2004/0021576 A1 * 2/2004 Scott et al. ..... 340/628
2004/0059817 A1 * 3/2004 Ueno et al. ..... 709/224
2005/0067049 A1 * 3/2005 Fima ..... 141/192
2007/0090059 A1 * 4/2007 Plummer et al. ..... 210/743
2007/0290872 A1 * 12/2007 Yamada et al. ..... 340/655
2008/0078337 A1 * 4/2008 Donnelly et al. ..... 122/446
2009/0009287 A1 * 1/2009 Falcioni et al. ..... 340/10.1
2009/0151652 A1 * 6/2009 Tian et al. ..... 122/14.1

* cited by examiner

*Primary Examiner* — Gregory A Wilson
(74) *Attorney, Agent, or Firm* — Michael Best & Friedrich LLP

(57) ABSTRACT

A gas water heater with a warning function, the gas water heater being disposed in a facility and comprising: a gas water heater main body including a controller having a warning cell; and a gas detecting unit separate from the main body and disposed at an indoor monitoring point of the facility, the gas detecting unit having a gas sensor and being in communication with the controller.

20 Claims, 4 Drawing Sheets

GAS WATER HEATER WITH HARMFUL GAS MONITORING AND WARNING FUNCTIONS AND THE METHOD OF MONITORING AND WARNING

TECHNICAL FIELD

The invention relates to a kind of gas water heater with harmful gas monitoring and warning functions, especially a kind of gas water heater can monitor and warn gas-leaking and CO gas. Meanwhile, it also involves the monitoring and warning methods of the gas water heater. The invention is attributed to technical field of gas appliances for domestic use.

BACKGROUND

Through patent searching, Joint Action Warning of Gas Water Heater in Chinese utility model patent 00237346.7 publishes a kind of circuit that can integrally process joint actions and auto-control on gas water heaters, ventilation equipment and gas-leaking and excessive exhaust gas warning. The circuit has realized the function that the leaking sensor works intermittently under the control of timing circular circuits. The water heater will be turned off after excessive exhaust gas is warned and the ventilation equipment will be run after gas-leaking is warned. Besides, Gas-leaking Protector of Gas Water Heater with an External A/D Convertor in Chinese design patent application 200510049317.5 provides a kind of gas-leaking protector of gas water heater with an external A/D convertor, through the external A/D convertor; gas sensor output is connected with the I/O input port of single-chip computer in water heater controller. Then the water heater controller is connected with the valve and warning circuits, achieving that the single-chip computer will cut off the gas source and warn when the gas is exceeded.

Searching oversea related patents show that although The Controlling System of Gas Water Heater disclosed by American Patent U.S. Pat. No. 5,797,358 has provided a controlling system that gas sensor, CO sensor and water heater processor are electrically connected, the above described problems still exist in the technology.

SUMMARY

Aiming for the shortcomings of the above existing technologies, the invention chiefly intends to put forward a kind of gas water heater having harmful gas monitoring and warning functions, especially a kind of gas water heater can monitor and warn gas-leaking and CO gas and offer corresponding monitoring and warning methods as well.

The further purpose of the invention lies in putting forward a kind of gas water heater that can detect whether the warning function is run out, thus to ensure the reliability and safety in using gas water heater.

In order to achieve the above chief purposes, the invention adopts the separate setup heater body and gas detector unit to gas water heater. The gas sensor is involved in the described gas detector unit, which is set up in the indoor place needs to be monitored and connected with the process control unit in the gas water heater body; the described gas detector unit and one of the process control units are connected to the warning unit.

The monitoring and warning steps of the gas water heater in the invention are: the gas detector unit converts the received signal of gas concentration into electric signal, then transmits to the process control unit in water heater body through communication; the process control unit in water heater body compares the transmitted signal with the preset threshold. When the signal exceeds the threshold, a warning command will be sent; after receiving the warning command, the warning unit will send out warning signal.

When the data process unit is contained in the gas detector unit itself, the monitoring and warning steps of the invention are: the gas detector unit converts the received signal of gas concentration into electric signal, and then transmits to the data process unit; the data process unit compares the transmitted signal with the preset threshold, and then transmits to the process control unit in water heater body through communication; or the data process unit directly transmits the signal to the process control unit in water heater body, then the process control unit compares the received signal with preset threshold; When the signal exceeds the threshold, a warning command will be made by the data process unit and one of the process control units; after receiving the warning command, the warning unit will send out a warning signal.

To achieve the further purposes, the process control unit in water heater body and the gas detector unit are connected by duplex wire or wireless communications. The process control unit sends out a testing signal and transmits it to the gas detector unit in working. If the gas detector unit cannot make response normally, the process control unit sends out an announcing signal.

A further perfection to the invention is that the control output port of the process control unit in water heater body is connected with the controlling unit of the gas transportation line valves. When the received detected signal exceeds the threshold, a warning command and a control signal will be made simultaneously, and the gas transportation line valves will be cut off.

In such case, the gas detector unit can be flexibly fixed in the places that gas and CO concentration can be easily collected, according to the actual needs. The water heater is installed in safe and easily-controlled positions. If the user doesn't need gas detecting function or the gas detector unit is running out and in servicing, the process control unit in water heater body will work according to no warning function setup. Meanwhile, an announcing message of "The gas detector unit is run out" will be shown on the host computer. When the chief controller of the water heater detects the gas detector unit works normally, it accepts and responds to the signal sent by the gas detector unit in time and control the warning and cut off the gas source through processing.

It is easily understood that the beneficial effects of the invention is: gas water heaters of various types (especially the speedy gas water heater) and the gas detector unit can be installed separately, thus to overcome the limitations of the existing technologies, such as it can't monitor the leaking in transportation pipe or some other sections and other gas equipments may let out exhaust gas in application. Meanwhile, the invention can effectively prevent the accidents from causing by indoor gas-leaking or concentration of CO gas excess in using gas water heater and bring more use value to the user and the society.

DETAILED DESCRIPTION

Combined with attached figures, the author will select some excellent implementing examples to make a further instruction to the patent.

Implementing Example 1

Figure 1:
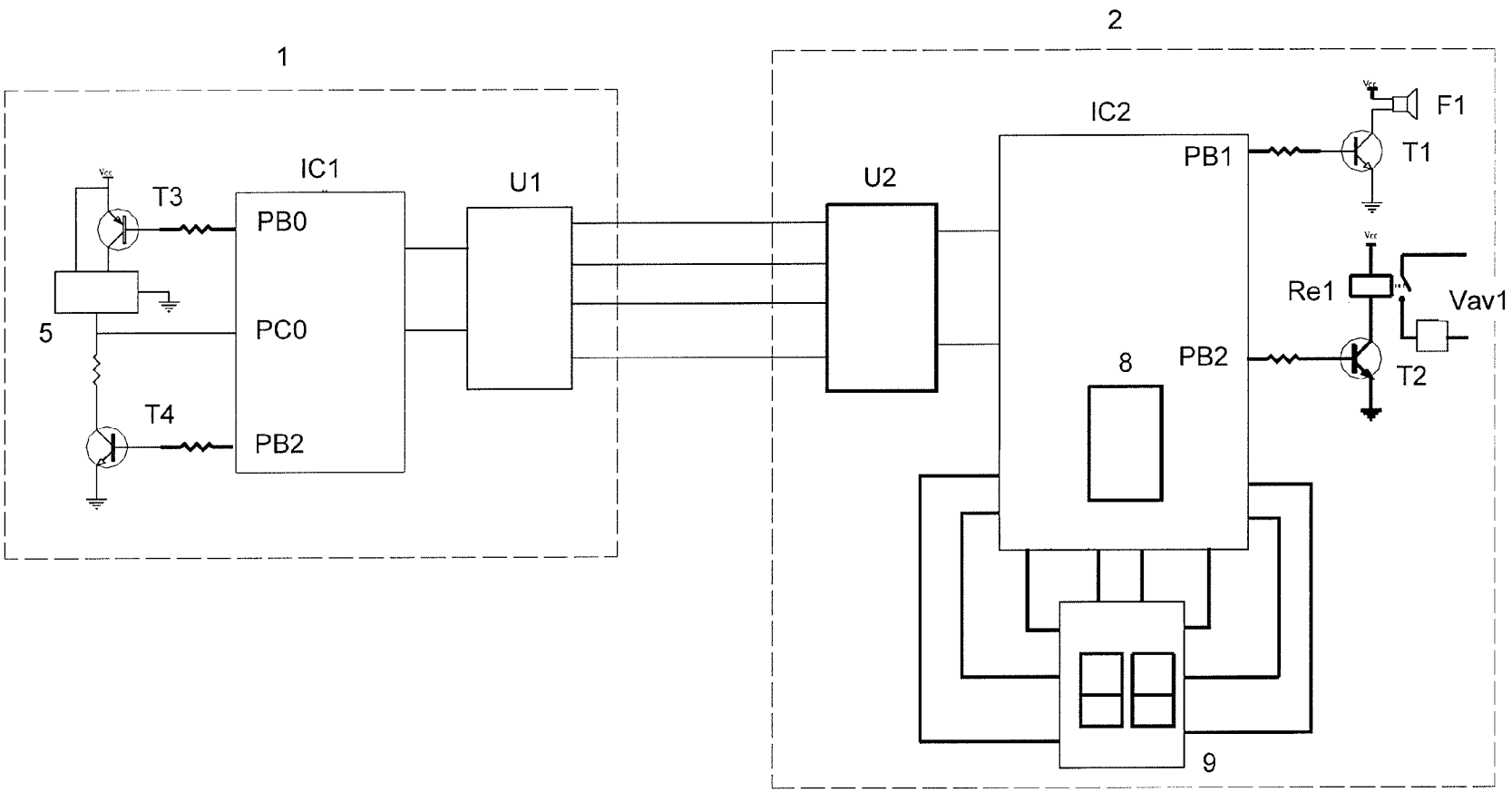
FIG. 1 is the circuit diagram of the implementing example 1 in the invention.

Gas water heater having gas-leaking and/or CO gas warning functions in this implementing example is shown as FIG. 1.

Gas detector unit 1 and the gas water heater body 2 are disassembled and can be installed separately. The two parts process data communications with the serial port communication chips U1 (Type MAX202) and U2 (Type MAX202) and the electric power is offered by the water heater.

Data process chip IC2 (Type H83694), display module 9, communication chip U2, buzzer F1 and gas valve Vav1 functioning as the process control unit are contained in the water heater body. IC2 contains the memory unit EEPROM8.

CO sensor 5 Type TGS2442, data process chip IC1 (Type Mega 8) and IC1 serial port communication chips U1 (Type MAX202) are contained in gas detector unit 1, they process serial port communications with the water heater body. The I/O ports PB1 and PB2 of IC1 output impulse signals control CO sensor 5 through on-and-off pipes T3 and T4. CO sensor 5 can feel the gas concentration in the ambient environment through sensitive materials, and then outputs the change of voltage and transmits it to I/O ports PCO of IC1. After receiving the change of voltage, PCO processes A/D transformation with the internal A/D transforming module and converts to practical concentration values. Meanwhile, PCO detects whether the CO concentration exceeds the defined warning concentration. Then, through serial port data communication chips U1 and U2, IC1 sends a message of concentration values to the data process chip IC2 in the water heater body. IC2 receives the data message from gas detector unit 1 through serial port communication chips U2, and then displays the data in time through display module 9. Meanwhile, IC2 sets the saving time of the data in terms of procedures and saves them in EEPROM 8 so as to offer useful data if necessary. At the same time, based on the data message from serial port communication chips U2, IC2 makes PB1 and PB2 control buzzer F1 and gas valve Vav1 switch through on-and-off pipes T1, T2 and relay Re1.

Besides, IC1 can detect in time whether the CO sensor 5 is running out and transmits the message to IC2 through communication chip U1 and U2. If the detection is failed, IC2 will control the operation of the water heater and provide a clue message based on the message.

When the concentration value of indoor CO gas is lower than the defined warning value, IC2 outputs the message received from serial port communication chip U2 to display module 9, and the water heater works normally; when the concentration value of indoor CO gas is higher than the defined warning value, IC2 outputs a control signal to on-and-off pipe T2 and cuts off the power of gas valve Vav1 through Relay Re1; at the same time, IC2 outputs the signal to on-and-off pipe T1 and controls buzzer F1 to warn; IC2 also offers a data signal and outputs warning codes through display module 9.

When the users apply other gas equipments instead of the gas water heater but here the water heater is electrically connected, if the indoor CO concentration doesn't achieve the defined warning concentration, gas detector unit 1 will feed back a concentration signal to IC2; the chief controller IC2 will show the signal on display module 9 after receiving it; if the indoor CO concentration increases and achieves the defined warning concentration, the chief controller IC2 will start buzzer F1 after receiving the signal, and then controls display module 9 to put up a flashing warning and sends out related control signals to prevent gas valve Vav1 from starting. When the indoor gas concentration resumes to the normal condition, gas detector unit 1 will feed back a signal to IC2; after receiving the signal, IC2 will stop the acousto-optic warning of buzzer F1 and display module 9 and release a signal of forbidding opening the gas valve Vav1.

Figure 2:
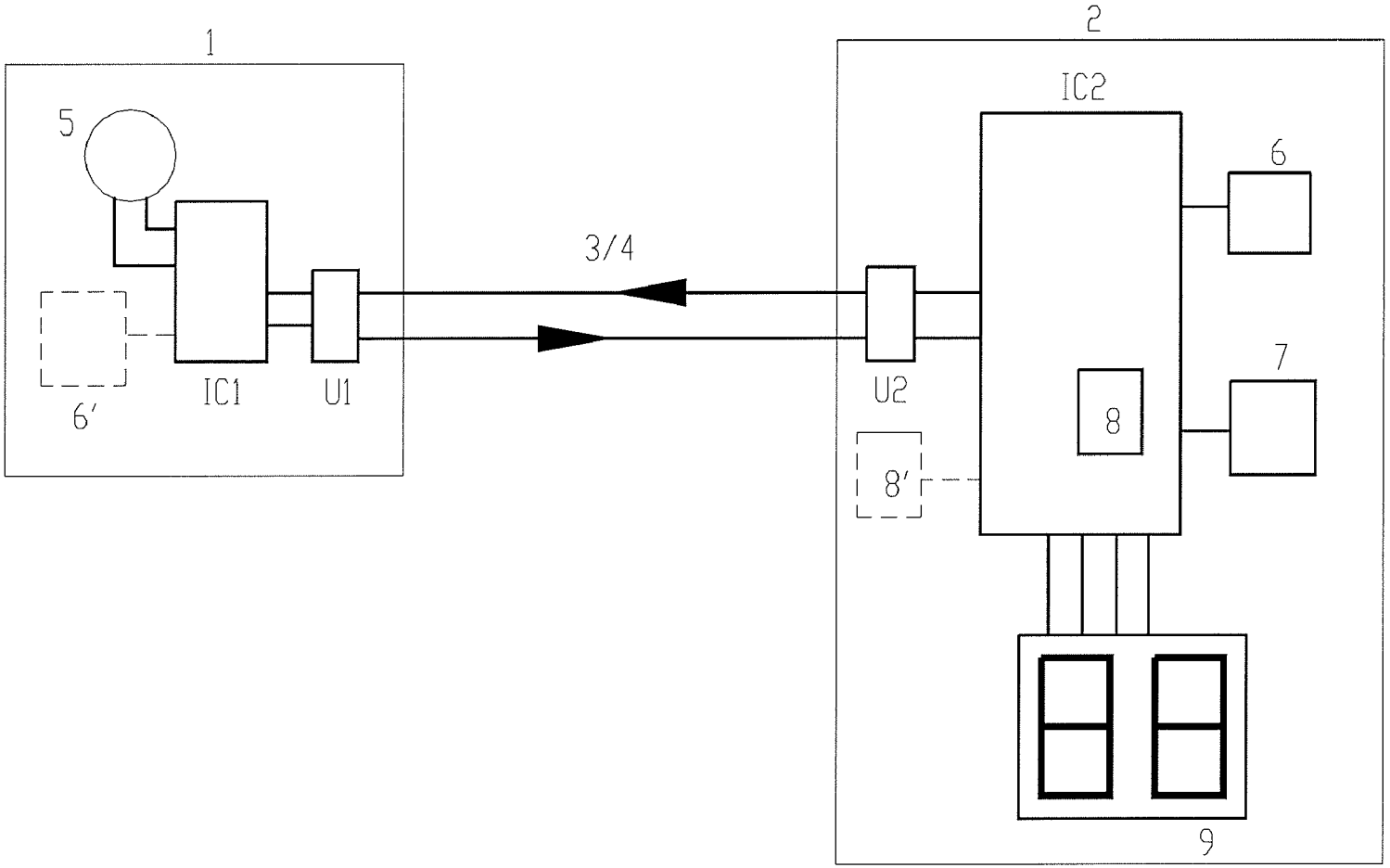
FIG. 2 is the principle frame figure corresponding to the implementing example in FIG. 1.

Referring to FIG. 2, the working process of the implementing example can be simply described as follow: when there is flammable gas and/or CO gas within the room, gas sensor 5 outputs related signals to the data process chip IC1 after detecting the gas concentration; the data process chip IC1 converts corresponding concentration numerical values after detecting the signals from sensor 5 and judges if the concentration value exceeds the defined warning concentration. Then IC1 transmits the related data to the water heater data process chip IC2 through data communication modules U1 and U2; based on related data, IC2 controls display module 9 to show the concentration and saves the data on memory module 8. If the concentration value exceeds the defined warning concentration, IC2 will make warning module 6 to put up an acousto-optic warning and cut off the gas valve through gas valve control module 7.

After detecting the signal from sensor 5, the data process chip IC1 can also directly transmit the signal to water heater data process chip IC2 through data communication modules U1 and U2. The data will be converted into corresponding numerical values by IC2 and judged if the concentration value exceeds the defined warning concentration, then corresponding controlling measures will be made. After converting the signal from sensor 5 into corresponding numerical values, the data process chip IC1 can also transmit the signal to IC2 through data communication modules U1 and U2. Corresponding controlling measures can be made after judged by IC2.

6' in the figure indicates that the warning module can be positioned with the detect unit as well and 8' indicates that the saving module can be externally installed.

Implementing Example 2

Figure 3:
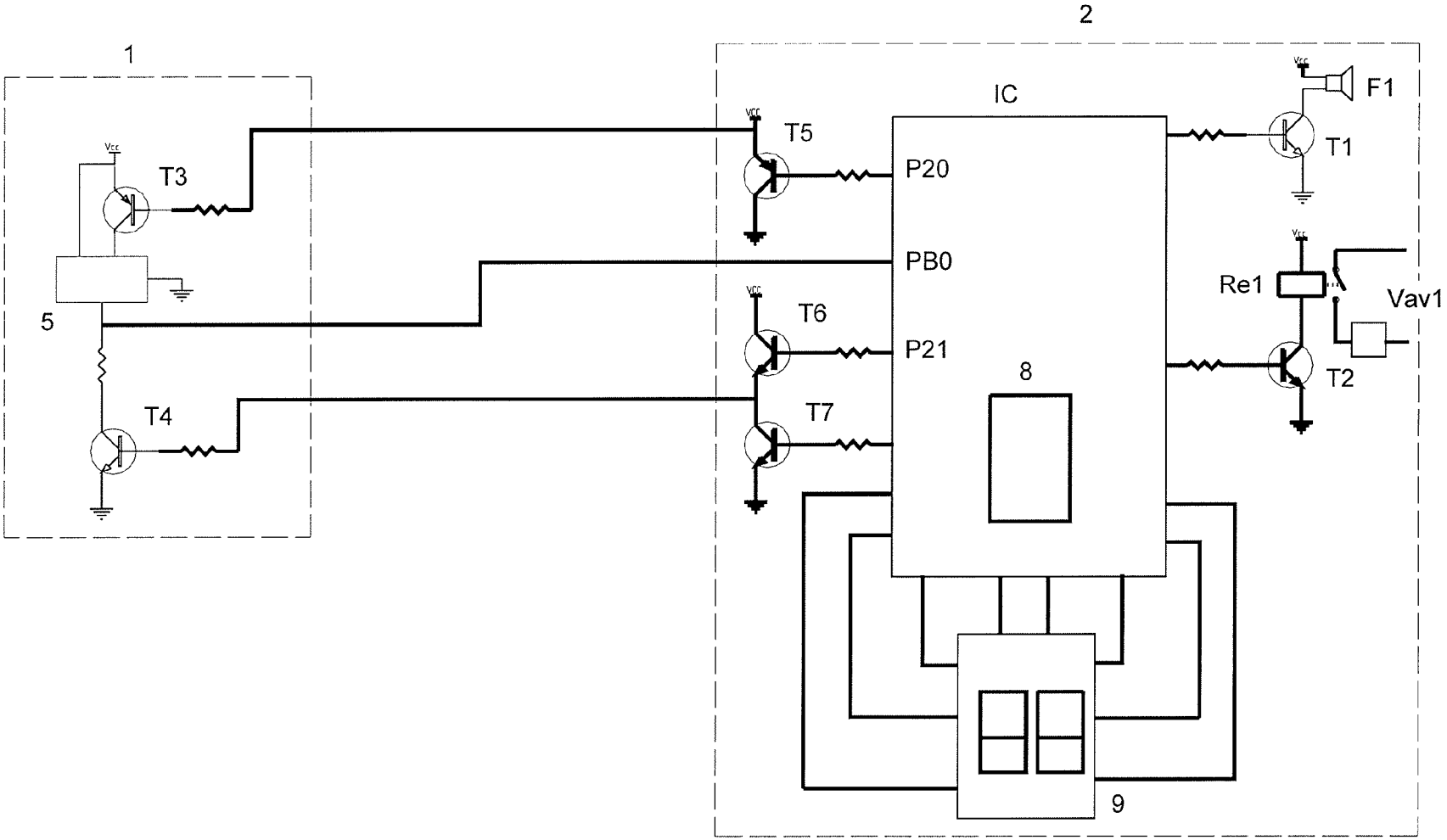
FIG. 3 is the circuit principle figure of the implementing example 2 in the invention.

Basic status of the circuit principle in this implementing example is similar with the above example, just shown as FIG. 3. Similarly, gas detector unit 1 and gas water heater body 2 are installed separately and connected with signal lines. Their difference lies in that the I/O port P20 and P21 impulse signals of data process chip IC (Type H83694) are contained in the gas water heater body 2; sensor 5 on gas detector unit 1 is controlled by on-and-off pipes T3, T4, T5, T6 and T7; CO sensor 5 feels the gas concentration in the ambient environment through sensitive materials, and then outputs the change of voltage and transmits to the I/O port PBO of IC. After receiving the change of voltage, PBO processes A/D transformation with the internal A/D transforming module and converts into practical concentration values. Meanwhile, PBO detects whether the CO concentration exceeds the defined warning concentration. The working principles can be referred to the above described practical example. Here the author won't say any more.

Figure 4:
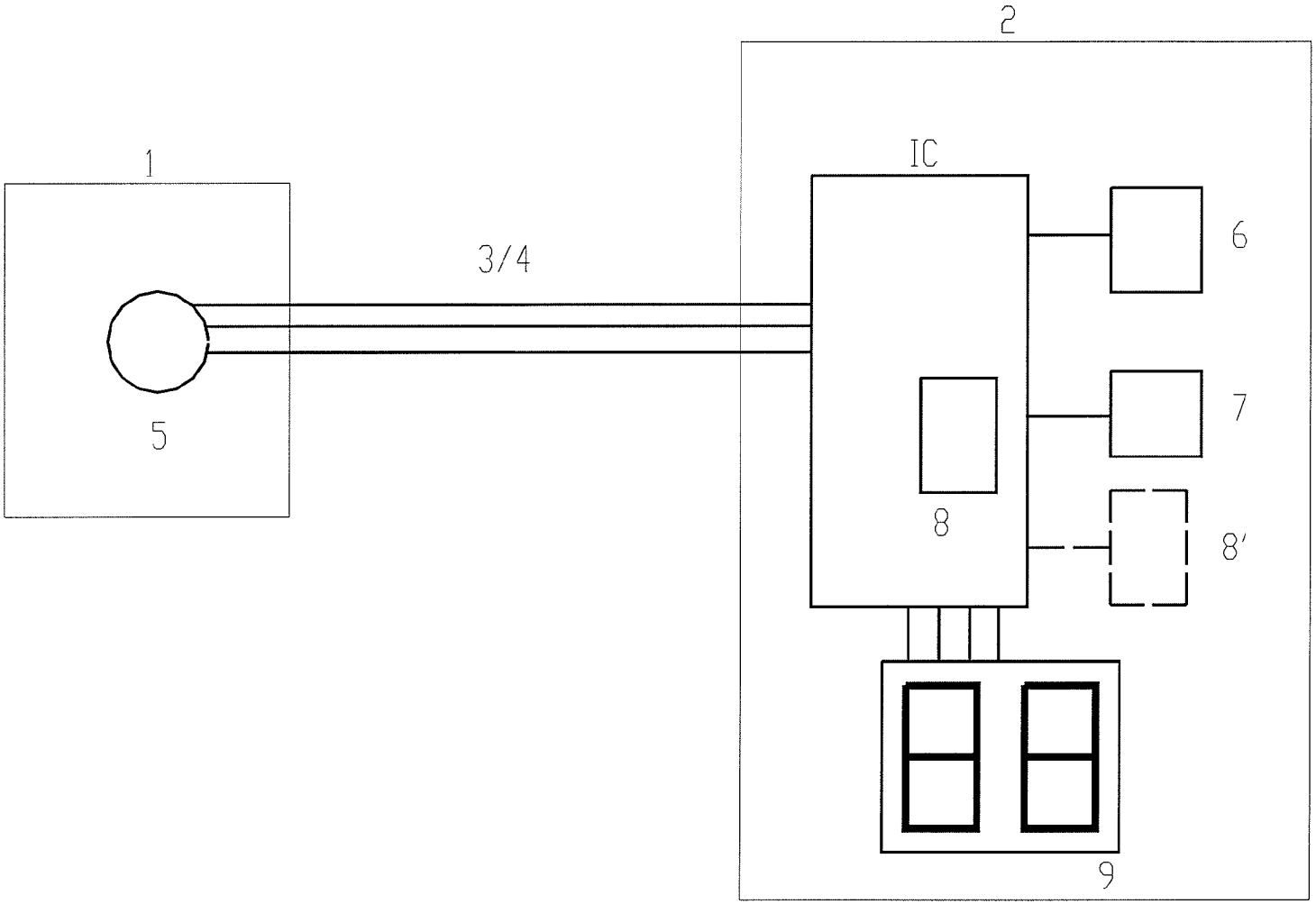
FIG. 4 is the principle frame figure corresponding to the implementing example in FIG. 3.

Its working principles can be referred to FIG. 4. When there is flammable gas and/or CO gas within the room, gas sensor 5 outputs related signals to the data process chip IC after detecting the gas concentration; the data process chip IC converts the data into corresponding concentration numerical values after detecting the signals from sensor 5 and judges if the concentration value exceeds the defined warning concentration. IC controls display module 9 to show the concentration based on the concentration and saves the data to memory module 8. If the concentration value exceeds the defined warning concentration, IC will make warning module 6 to put up acousto-optic warning and cut off the gas valve through gas valve control module 7.

The invention is not limited to the above described implementing examples; many other changing designs are permitted. For example, the communication mode can includes both wire and wireless, duplex and simplex; warning unit can be controlled either by the process control unit in the water heater body, or by the data process unit within the detect unit directly; display warning in the warning unit can either be shown on the screen of gas water heater, or set up individually; various separate devices within the circuit can be further integrated or the integrated devices can be further separated; and so on. Any technical scheme formed by adopting the equivalent substitution or the equivalent transformation is under the protection of the invention requirements.

Various features and advantages of the invention are set forth in the following claims.

The invention claimed is:

1. A method of controlling a gas water heater having a warning function, the gas water heater including a main body and a gas detecting unit, the gas detecting unit including a processor and a sensor, the main body including a gas water heater controller and the gas water heater being disposed in a facility, the method comprising:

disposing the gas detecting unit at an indoor monitoring point separate from the main body;

the processor outputting impulse signals through on-and-off pipes to control the sensor;

the processor detecting whether the sensor is operating properly;

the gas detecting unit sensing a gas concentration;

the gas detecting unit converting the sensed gas concentration into a gas concentration value;

the gas detecting module unit transmitting to the controller a signal based on the gas concentration value;

comparing the gas concentration value with a threshold; and the controller initiating a warning after the gas concentration value traverses the threshold.

2. A gas water heater, comprising:

a main body;

a controller supported by the main body and including a first serial communication circuit;

a gas detecting unit separate from the main body and including a processor, a gas sensor, and a second serial communication circuit, the gas detecting unit installed at an indoor monitoring point and communicating to the controller via the second serial communication circuit; and a warning device positioned in one of the controller and the gas detecting unit;

wherein the processor controls the sensor and detects whether the sensor is operating properly, and wherein the controller communicates with the gas detecting unit using duplex communication.

3. The gas water heater of claim 2, wherein the gas detecting unit detects at least one of leaking gas and carbon monoxide.

4. The gas water heater of claim 2, wherein an output port of the controller is connected a gas valve in a gas supply pipeline.

5. The gas water heater of claim 2, further comprising a display module in the main body connected to the controller for displaying a detected carbon monoxide concentration and providing a warning indication when the detected carbon monoxide concentration exceeds a threshold.

6. The gas water heater of claim 2, wherein the main body includes a memory module connected to the controller, the memory module storing detected data for later retrieval.

7. A gas monitoring and warning method for a gas water heater including a main body and a gas detecting unit having a processor, the method comprising:

outputting impulse signals through on-and-off pipes to control a sensor of the gas detecting unit;

the processor detecting whether the sensor is operating properly;

detecting a gas concentration of at least one of leaking gas and carbon monoxide;

converting the detected gas concentration into an electrical signal;

transmitting the electrical signal to a controller serially;

comparing the electrical signal with a threshold; and producing a warning when the signal exceeds the threshold.

8. The gas monitoring and warning method of claim 7, wherein the controller is positioned in a main body of a gas water heater and communicates with a remote gas detecting unit by duplex communication.

9. The gas monitoring and warning method of claim 8, further comprising closing a gas valve in a gas supply pipeline when the electrical signal exceeds the threshold.

10. The gas monitoring and warning method of claim 7, wherein the warning is an audible alarm.

11. The gas monitoring and warning method of claim 10, wherein a gas detecting unit, separate from the controller performs the comparing step and produces the audible alarm.

12. The gas monitoring and warning method of claim 7, wherein the controller sends a test signal to a gas detecting unit, the controller producing a warning when the gas detecting unit does not respond normally to the test signal.

13. The gas monitoring and warning method of claim 7, further comprising saving the detected gas concentration for later retrieval.

14. A gas water heater, comprising:

a main body;

a controller supported by the main body and including a first serial communication circuit;

a gas detecting unit separate from the main body and including a processor, a gas sensor, and a second serial communication circuit, the gas detecting unit installed at an indoor monitoring point and communicating to the controller via the second serial communication circuit; and a warning device positioned in one of the controller and the gas detecting unit;

wherein the processor controls the sensor and detects whether the sensor is operating properly, and wherein the main body includes a memory module connected to the controller, the memory module storing detected data for later retrieval.

15. The gas water heater of claim 14, wherein the controller communicates with the gas detecting unit using duplex communication.

16. The gas water heater of claim 14, wherein the gas detecting unit detects at least one of leaking gas and carbon monoxide.

17. The gas water heater of claim 14, wherein an output port of the controller is connected a gas valve in a gas supply pipeline.

18. The gas water heater of claim 14, further comprising a display module in the main body connected to the controller for displaying a detected carbon monoxide concentration and providing a warning indication when the detected carbon monoxide concentration exceeds a threshold.

19. The gas water heater of claim 14, wherein the on-and-off pipes controlling the sensor are positioned at the gas detecting unit.

20. The gas water heater of claim 14, wherein the on-and-off pipes controlling the sensor are positioned at the main body.

* * * * *